US007285085B2

(12) United States Patent
Kim et al.

(10) Patent No.: US 7,285,085 B2
(45) Date of Patent: Oct. 23, 2007

(54) AUTOMATIC BALANCING ROTOR FOR CENTRIFUGE

(75) Inventors: Do-Gyoon Kim, Daejeon (KR); Heui-Geun Ryu, Seoul (KR)

(73) Assignee: Hanlab Corporation, Seoul (KR)

( * ) Notice: Subject to any disclaimer, the term of this patent is extended or adjusted under 35 U.S.C. 154(b) by 72 days.

(21) Appl. No.: 10/547,476

(22) PCT Filed: Nov. 19, 2004

(86) PCT No.: PCT/KR2004/003011

§ 371 (c)(1),
(2), (4) Date: Aug. 30, 2005

(87) PCT Pub. No.: WO2006/033502

PCT Pub. Date: Mar. 30, 2006

(65) Prior Publication Data

US 2006/0252627 A1 Nov. 9, 2006

(30) Foreign Application Priority Data

Sep. 23, 2004 (KR) ..... 10-2004-0076489

(51) Int. Cl.
*B04B 5/02* (2006.01)
*B04B 9/14* (2006.01)

(52) U.S. Cl. ..... 494/20; 494/82; 74/572.4

(58) Field of Classification Search ..... 494/1, 494/10, 12, 20, 33, 82, 84; 73/457–458; 74/573 R, 572.4; 68/23.1, 23.2; 210/85, 210/144

See application file for complete search history.

(56) References Cited

U.S. PATENT DOCUMENTS

| | | | | |
|---|---|---|---|---|
| 3,834,613 | A * | 9/1974 | Hankey | 494/16 |
| 4,157,781 | A | 6/1979 | Maruyama | |
| 4,412,831 | A | 11/1983 | Avery et al. | |
| 4,547,185 | A | 10/1985 | Hellekant | |
| 4,919,646 | A * | 4/1990 | Perdriat | 494/1 |
| 5,376,063 | A * | 12/1994 | Greenstein | 494/37 |
| 6,949,063 | B2 * | 9/2005 | Baik et al. | 494/1 |
| 7,025,714 | B2 * | 4/2006 | Escal | 494/1 |

(Continued)

FOREIGN PATENT DOCUMENTS

JP 63062563 A * 3/1988

(Continued)

OTHER PUBLICATIONS

English Language Abstract of Korea 10-2002-0017498, published Apr. 17, 2002.

(Continued)

*Primary Examiner*—Charles E. Cooley
(74) *Attorney, Agent, or Firm*—Greenblum & Bernstein, P.L.C.

(57) ABSTRACT

An automatic balancing rotor for a centrifuge which compensates for imbalance of a centrifugal force occurring due to a weight difference of samples. The automatic balancing rotor includes a plurality of rotating arms spaced at regular angular intervals, with a plurality of buckets containing the samples supported by the rotating arms. The automatic balancing rotor includes a balance weight provided in each of the rotating arms to be movable in a radial direction, thus compensating for imbalanced centrifugal force applied to the buckets, and a balance weight mover which horizontally moves the balance weight in the radial direction of each of the rotating arms.

5 Claims, 3 Drawing Sheets

U.S. PATENT DOCUMENTS

| | | | | |
|---|---|---|---|---|
| 7,115,090 | B2 * | 10/2006 | Lagarde | 494/10 |
| 2004/0018927 | A1 | 1/2004 | Baik et al. | |
| 2006/0252627 | A1 * | 11/2006 | Kim et al. | 494/20 |
| 2007/0027014 | A1 * | 2/2007 | Ryu et al. | 494/10 |

FOREIGN PATENT DOCUMENTS

| | | | |
|---|---|---|---|
| JP | 3293047 | | 4/2002 |
| JP | 2003236409 | A * | 8/2003 |
| KR | 10-20020017498 | | 4/2002 |
| WO | 02/083317 | | 10/2002 |
| WO | WO 2006054828 | A1 * | 5/2006 |

OTHER PUBLICATIONS

English language Abstract of JP 06-247331, published Sep. 6, 1994.

* cited by examiner

AUTOMATIC BALANCING ROTOR FOR CENTRIFUGE

TECHNICAL FIELD

The present invention relates, in general, to automatic balancing rotors for centrifuges and, more particularly, to an automatic balancing rotor for centrifuges which senses imbalance of the weight of samples, contained in buckets, prior to every centrifugal separation and radially moves balance weights, provided in rotor aims, according to the weight sensing result, thus dynamically maintaining balance during the centrifugal separation.

BACKGROUND ART

Generally, centrifuges are apparatuses m which a rotor containing samples is rotated at high speed to apply a high centrifugal force to the samples, so that a high density fraction is moved radially outwards and a low density fraction is moved radially inwards, thus separating the fractions from each other.

FIG. 1 is a sectional view showing a conventional automatic balancing rotor for centrifuges. As shown in FIG. 1, the conventional automatic balancing rotor for centrifuges uses a mechanism, in which a lever central body 636 is horizontally moved according to a control algorithm, to compensate for imbalance between samples contained in buckets supported by rotational aims 632. Here, the lever moving mechanism includes a worm 662 which is axially coupled to a lever moving motor 652, a worm gear (not shown) which engages with the worm 662, a pinion 666 which is coaxially coupled to the worm gear, and the lever central body 636 having a rack 636*a*, which engages with the pinion 666.

Furthermore, a pressure sensor 690 is provided under each rotational arm 632 to measure the weight of the sample contained in the associated bucket (not shown). A wiring layer 562 is integrally coupled to a lower part of the rotor to receive an electrical signal from the pressure sensors 690 and transmit an electrical signal to the lever moving motor 652 according to a control algorithm, thus balancing the centrifuge.

The conventional automatic balancing rotor for centrifuges having the above-mentioned construction senses imbalance of the samples by measuring the weight of the buckets provided at both ends of the rotor lever, and controls the distance between each bucket and a rotating shaft of the rotor according to the weight difference of the samples, thus applying the same centrifugal force to the opposite buckets containing the samples. Thereby, the samples contained in the buckets maintain a dynamic balance state during the rotation of the rotor for centrifugal separation. More details are described in Korean Application No. 10-2002-0017498 (publication date: Apr. 17, 2002) which was filed by the inventor of the present invention, therefore further explanation is deemed unnecessary.

DISCLOSURE OF INVENTION

Technical Problem

However, in the above-mentioned conventional automatic balancing rotor for centrifuges, because the rotor is balanced by moving the lever central body in a radial direction of the rotor, as the weight difference between the opposite buckets containing samples increases, a rotational radius of the rotor lever increases. Therefore, the space required for rotation of the rotor increases.

Moreover, as the distance from the rotating center to one bucket containing a sample increases, the distance from the rotating center to the other bucket is reduced by the increased distance of the opposite side. Then, centrifugal force is differentially applied to the samples contained in the opposite buckets. Thereby, the samples may be excessively or incompletely separated. Furthermore, there is a predetermined minimum limit in balancing the rotor due to a limited distance that the lever central body is horizontally moved, and due to back lash of a horizontal moving unit

Technical Solution

Accordingly, the present invention has been made keeping in mind the above problems occurring in the prior art, and an object of the present invention is to provide an automatic balancing rotor for centrifuges which compensates for an imbalance of a centrifugal force due to a weight difference of samples by horizontally moving balance weights provided in rotor arms without changing the length of the rotor aims, thus reducing the space that the automatic balancing rotor occupies, and applying the same centrifugal force to the samples contained in the buckets, and preventing the rotor from being affected by back lash during the automatic balancing process.

Advantageous Effects

In an automatic balancing rotor for centrifuges according to the present invention, imbalance of a centrifugal force of the rotor due to a weight difference of samples is compensated for by controlling rotational radii of balance weights provided in rotor arms. Therefore, vibration of the automatic balancing rotor due to imbalance is prevented from occurring during centrifugal separation, thereby the lifetime of the automatic balancing rotor and of a centrifuge having the rotor is extended, and the samples are prevented from damage.

Furthermore, because it is unnecessary for a user to weigh the samples or control the number of samples, the centrifugal separation of the samples is correctly and rapidly executed, thus reducing the time required for the centrifugal separation. In addition, compared with conventional two-arm swing rotors using a method of directly moving a rotor lever, the automatic balancing three-arm rotor of the present invention using a balance weight moving method can reduce the space required for centrifugal separation, therefore it is particularly useful in a centrifuge having a large capacity. As well, because the slot to guide the balance weight can be longitudinally formed through nearly all of the rotor arm, a sufficient balance weight moving distance is ensured, thereby minimizing the effect of back lash occurring between the balance weight and the balance weight moving shaft.

BEST MODE FOR CARRYING OUT THE INVENTION

In order to accomplish the above object(s), the present invention provides an automatic balancing rotor for a centrifuge, including: a plurality of rotating arms having the same radial length and being arranged around a centrifugal rotating shaft, and being spaced out at regular angular intervals, with a plurality of buckets containing samples therein supported by the rotating arms; a balance weight provided in each of the rotating arms to be movable in a radial direction, thus compensating for imbalanced centrifugal force applied to the buckets during a centrifugal separation; and a balance weight moving mean to horizontally move the balance weight in the radial direction of each of the rotating arms.

The buckets may be supported in spaces defined between the rotating arms respectively. Furthermore, each of the rotating arms may include a slot formed through the rotating arm in the radial direction to receive therein the balance weight and guide the horizontal movement of the balance weight. The balance weight may have an internal thread formed through a center of the balance weight. The balance weight moving means may have: a balance weight moving motor, a worm axially coupled to the balance weight moving motor, a worm gear engaging with the worm; and a balance weight moving shaft radially provided in the slot of the rotating arm and having an external thread on an outer surface thereof to engage with the internal thread of the balance weight. The balance weight moving shaft is coaxially coupled at an end thereof to the worm gear.

The automatic balancing rotor may further include a reference position sensing means provided at a predetermined position in the slot of the rotating arm to sense the balance weight placed at a reference position.

MODE FOR THE INVENTION

Hereinafter, an automatic balancing rotor for centrifuges according to a preferred embodiment of the present invention will be described in detail with reference to the attached drawings.

Figure 1:
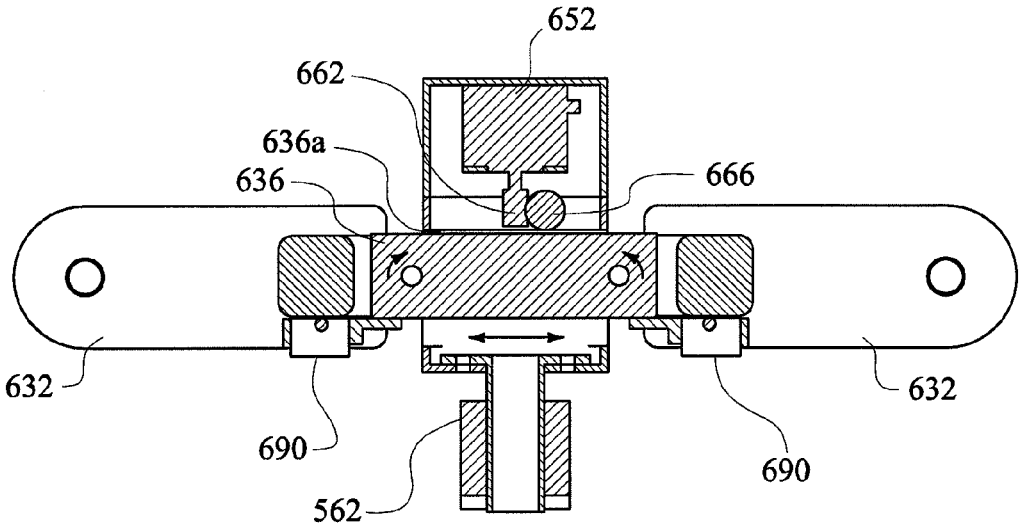
FIG. 1 Prior Art
FIG. 1 is a sectional view showing a conventional automatic balancing rotor for centrifuges.
Figure 2:
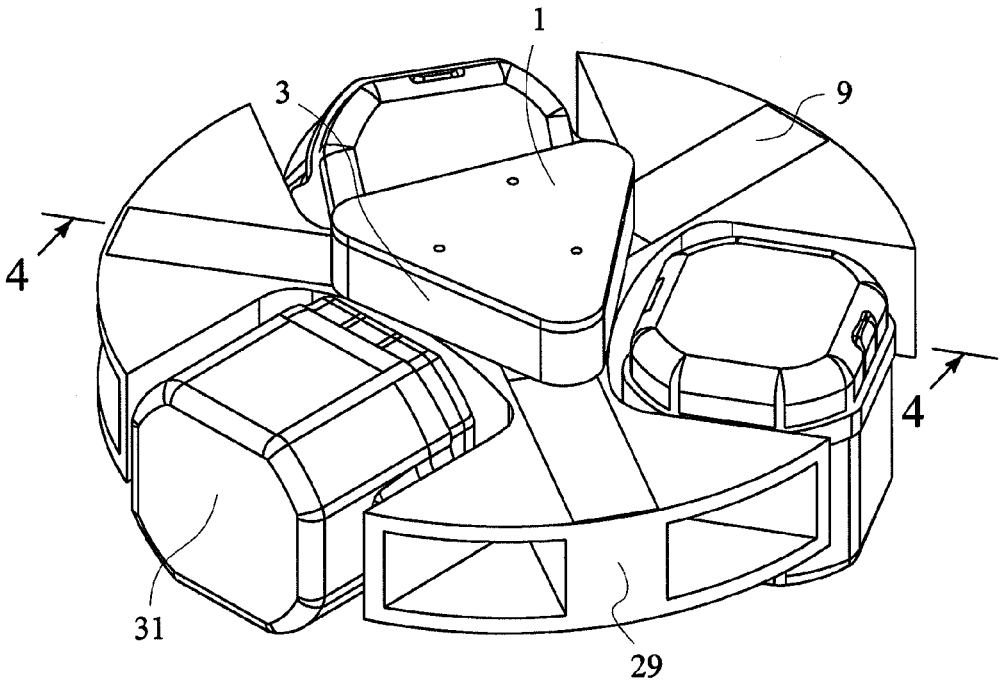
FIG. 2 is a perspective view of an automatic balancing rotor for centrifuges, according to an embodiment of the present invention.
Figure 3:
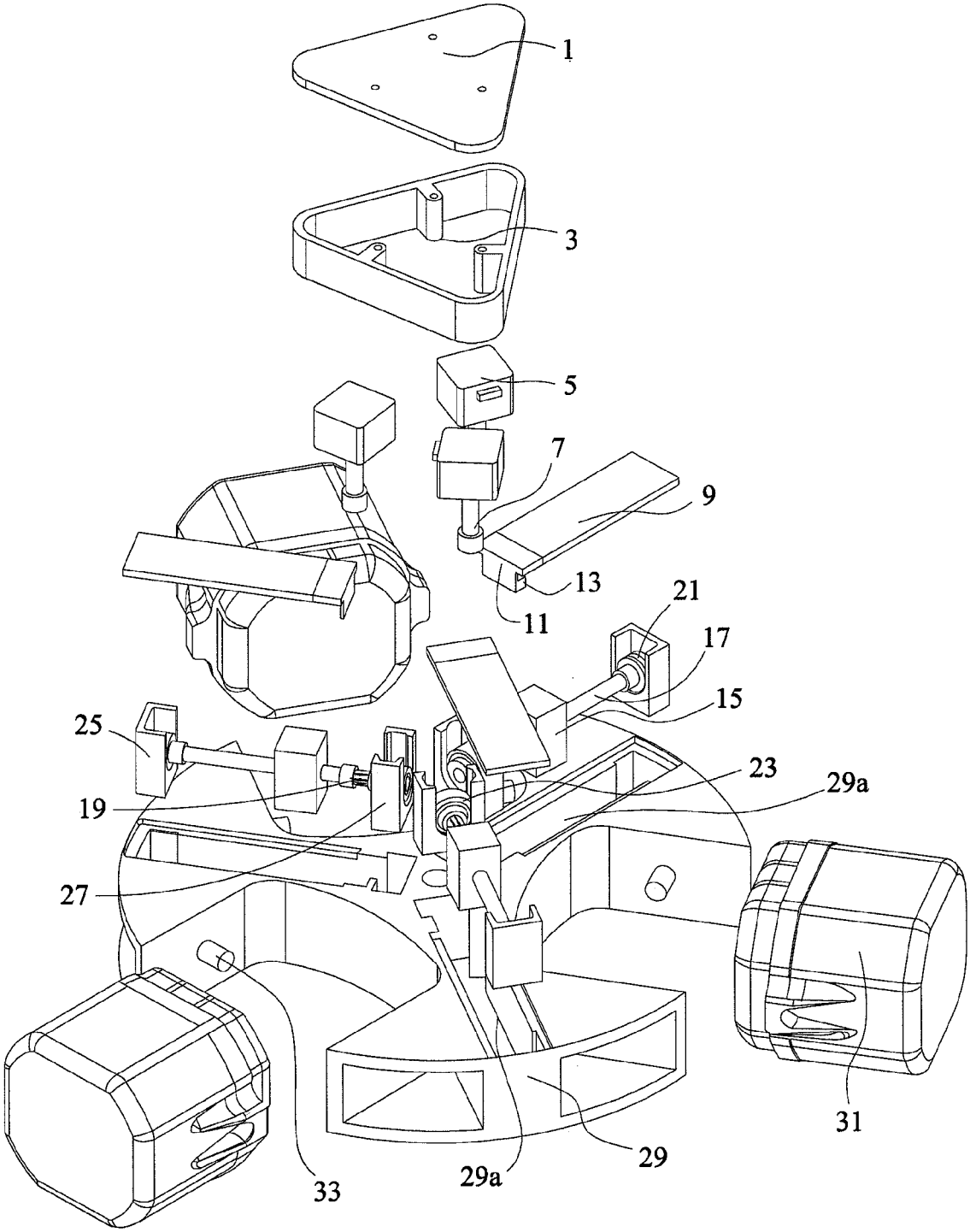
FIG. 3 is an exploded perspective view of the automatic balancing rotor of FIG. 2.
Figure 4:
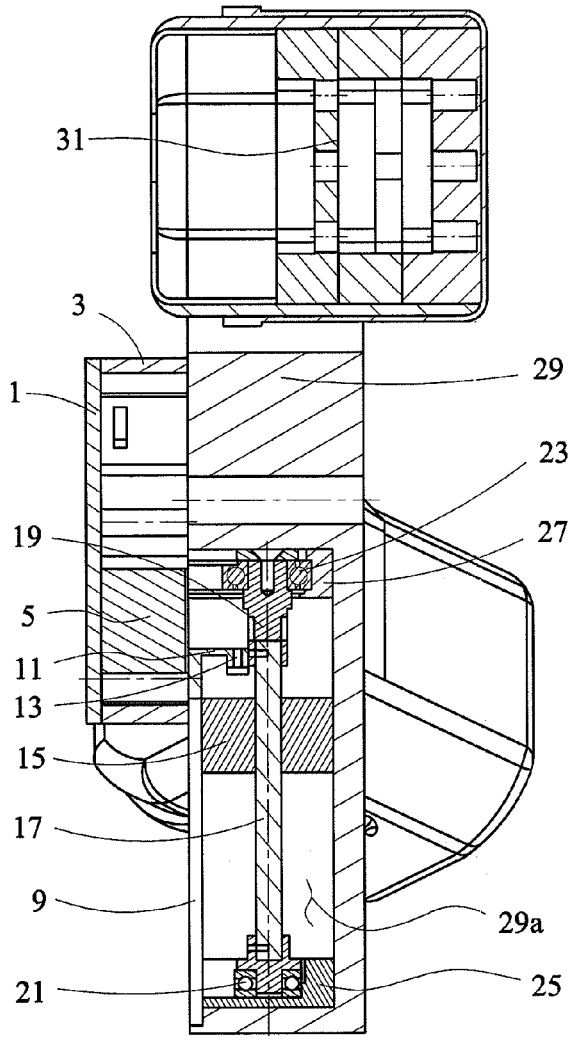
FIG. 4 is a sectional view of the automatic balancing rotor taken along the line 4-4 of FIG. 2.

FIG. 2 is a perspective view of an automatic balancing rotor for centrifuges, according to an embodiment of the present invention. FIG. 3 is an exploded perspective view of the automatic balancing rotor of FIG. 2. FIG. 4 is a sectional view of the rotor taken along the line 4-4 of FIG. 2. In the drawings, a three-arm swing rotor is shown as an example. As shown in FIGS. 2 through 4, the automatic balancing rotor for centrifuges according to the embodiment of the present invention includes three rotor arms 29 which support a plurality of buckets 31 containing samples therein. The automatic balancing rotor further includes a balance weight 15 which is provided in each of the rotor arms 29 to compensate for imbalanced centrifugal force applied to the buckets 31 during a centrifugal separation, and a balance weight moving means to horizontally move each balance weight 15 in the radial direction of each rotating arm 29.

In the above-mentioned construction, the rotor arms 29 are formed by cutting portions of a circular plate having a predetermined thickness at regular angular intervals, so that the buckets 31 are disposed in the cut portions. In this embodiment, the rotor arms 29 are spaced out at 120° intervals. A pair of bucket support pins 33 is provided on opposite sidewalls of each rotor arm 29 to rotatably support each bucket 31. Here, each bucket 31 is supported by the cooperation of two adjacent rotor arms 29.

In the meantime, a slot 29*a* is formed through each rotating arm 29 in the radial direction to receive therein each balance weight 15 and guide the horizontal movement of the balance weight 15. Preferably, the slot 29*a* has an elongated rectangular hole shape. Furthermore, it is preferred that the balance weight 15 have a hexahedral shape to prevent the balance weight 15 from rolling in the slot 29*a*. An internal thread (not shown) is formed through the center of each balance weight 15.

Each balance weight moving means has a balance weight moving motor 5 which is provided on a central portion of the automatic balancing rotor such that an output shaft of the balance weight moving motor 5 is vertically disposed. The balance weight moving means further has a worm 7 which is axially coupled to an end of the output shaft of the balance weight moving motor 5, and a balance weight moving shaft 17 which is longitudinally provided in the slot 29*a* of the rotor arm 29. The balance weight moving shaft 17 has an external thread on an outer surface thereof that engages with the internal thread of the balance weight 15. The balance weight moving means further has a worm gear 19 which is axially coupled to an end of the balance weight moving shaft 17 and engages with the worm 7, and a thrust bearing 21 and a radial bearing 23 which are coaxially coupled to opposite ends of the balance weight moving shaft 17.

To sense a reference position for each balance weight 15 which horizontally moves in the slot 29*a*, a reference position sensor 13, preferably a limit switch, is required. Such a reference position sensor 13 is provided at a predetermined position in each slot 29*a* Preferably, the reference position sensor 13 is mounted to a support bracket 11 which extends a predetermined length downwards from a slot cover 9.

In the drawings, the reference numerals 3 and 1 respectively denote a support frame to support therein the balance weight moving motors 5, and a motor cap to cover the support frame 3. The reference numeral 9 denotes a slot cover to cover an open upper end of each slot 29*a*. The reference numerals 25 and 27 denote bearing supports to support each thrust bearing 21 and each radial bearing 23 in each slot 29*a*, respectively.

Figure 5:
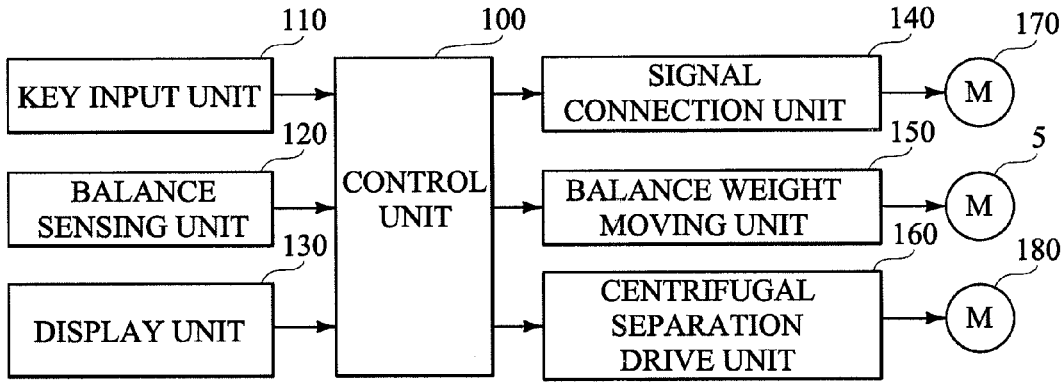
FIG. 5 is an electrical block diagram of a centrifuge having the automatic balancing rotor of the present invention.

FIG. 5 is an electrical block diagram of the operation of a centrifuge having the automatic balancing rotor of the present invention. As shown in FIG. 5, an electrical construction of the centrifuge having the automatic balancing rotor of the present invention includes a key input unit 110 to select and input various functions provided by the centrifuge having the automatic balancing rotor, and a balance sensing unit 120 which has a weight measuring apparatus (not shown) provided in the centrifuge and senses the weight of the samples contained in the buckets 31, which are supported by the rotor arms 29. The electrical construction of the centrifuge further includes a display unit 130 which displays information about the operation of the centrifuge on a display panel, and a control unit 100 which controls the entire operation of the centrifuge. The electrical construction of the centrifuge further includes a balance weight moving unit 150 which moves the balance weight 17 by driving the balance weight moving motor 5 along the balance weight moving shaft 17 from an initial position that is sensed by the reference position sensor 13. The electrical construction of the centrifuge further includes a signal connection unit 140 which connects a wiring connection board (not shown) to a wiring layer (not shown) by driving a wiring layer connection motor 170, thus forming an electrical system capable of transmitting a control command to the balance weight moving unit 150 according to a sensing signal from the balance sensing unit 120. The electrical construction of the centrifuge further includes a centrifugal separation drive unit 160 which rotates the three-arm swing rotor supporting the buckets 31 therein by driving a rotor drive motor 180.

In the above-mentioned construction, the balance weight moving motor 5 may be embodied by a stepping motor which is able to precisely control its rotation angle. Alternatively, the balance weight moving motor 5 may be embodied by a servomotor. The control unit 100 includes a balance weight moving distance calculating equation (see equation 1 which will be disclosed herein later) using the difference in weight of the samples, thus calculating the distance to move the balance weight 15 along the balance weight moving shaft 17 using the rotation of the balance weight moving motor 5.

Hereinafter, the operation sequence and principle of the centrifuge having the automatic balancing rotor of the present invention will be explained in detail.

First, a user puts adaptors (not shown) containing samples in three buckets 31 supported by the bucket support pins 33 of the rotor arms 29. Thereafter, the user inputs a control command suitable to a centrifugal separating condition for each sample using the key input unit 110. Then, the control unit 100 transmits the control command to the balance sensing unit 120. In the balance sensing unit 120, the weight measuring apparatus having a weight measuring sensor (not shown) measures the weight of the samples contained in the buckets 31 after spatially isolating the buckets 31 from the bucket support pins 33 by raising the buckets 31 upwards. Thereafter, the control unit 100 receives a signal about the weight of the samples measured by the balance sensing unit 120, and calculates a moving distance of each balance weight 15 to compensate for imbalance of the weight of the samples. Next, the control unit 100 transmits a control command to the signal connection unit 140, thus driving the wiring layer connection motor 170, so that the wiring connection board (not shown) is connected to the wiring layer (not shown).

Continuously, to control the rotation angle of each balance weight moving motor 5 corresponding to the calculated moving distance of each balance weight 15 through the connected signal connection unit 140, the control unit 100 first determines whether each balance weight 15 is placed at the initial reference position or not through a signal received from each reference position sensor 13 through the signal connection unit 140. Here, if a signal from a reference position sensor 13 indicates that the associated balance weight 15 is placed at an initial reference position, the control unit 100 transmits a control command to the balance weight moving unit 150 through the connected signal connection unit 140 to control the rotation angle of the associated balance weight moving motor 5. As a result of this, the balance weight 15 is advanced by the calculated distance along the balance weight moving shaft 17.

On the other hand, if a signal from a reference position sensor 13 indicates that the associated balance weight 15 is not placed at an initial reference position, that is, it is already advanced by a predetermined distance on the associated balance weight moving shaft 17, the control unit 100 transmits a control command to the balance weight moving unit 150 through the connected signal connection unit 140 to control the rotation angle of the associated balance weight moving motor 5 in a desired direction. Then, the balance weight 15 is retracted along the balance weight moving shaft 17 to the initial reference position. Simultaneously, the control unit 100 continuously reads a signal from the reference position sensor 13 and determines whether the balance weight 15 reaches the initial reference position or not. When the signal from the reference position sensor 13 indicates that the balance weight 15 reaches the initial reference position, the control unit 100 immediately stops the control signal, which has been transmitted to the balance weight moving motor 5, and reversely rotates the balance weight moving motor 5, thus advancing the balance weight 15 by the calculated distance along the balance weight moving shaft 17.

As such, when the balance weights 15 are moved by the calculated distances along the balance weight moving shafts 17, the balance weights 15 can compensate for imbalance among the buckets 31 containing the samples therein. As a result, even during the rotation of the automatic balancing rotor, it is possible to maintain the balance of centrifugal force among the samples and balance weights 15. After balancing the rotor, the control unit 100 transmits a control command to the signal connection unit 140 to drive the wiring layer connection motor 170, thus separating the wiring connection board from the wiring layer. In this state, the control unit 100 transmits a control command to the centrifugal separation drive unit 160 to drive the rotor drive motor 180. Then, the centrifuge executes a centrifugal separation process in a balanced state. In the meantime, the display unit 130 displays various kinds of information about both a current setting and operational conditions on the display panel during the centrifugal separation.

Of the description of the above-mentioned operational sequence and principle of the centrifuge having the automatic balancing rotor of the present invention, in the control unit 100, the moving distance of each balance weight 15 is calculated using the weight difference among the buckets 31 containing the samples which is measured by the weight measuring apparatus, so as to compensate for imbalance of the centrifugal force among the buckets 31 occurring due to the weight difference. This calculation of the balance weight moving distance is executed through a process which will be described step by step. First, the centrifugal force of each bucket 31, when rotated, is obtained from the weight of the bucket 31, the distance between the bucket 31 and the rotating shaft of the rotor, and the set rotating speed. A vector value of a total centrifugal force of the buckets 31 is obtained by summing vectors of the centrifugal forces of the buckets 31. Next a centrifugal force of each balance weight 15 can be determined from the weight of the balance weight 15, a distance between the balance weight 15 and the rotating shaft of the rotor to be induced, and the set rotating speed A vector value of a total centrifugal force of the balance weights 15 can be calculated by summing vectors of the centrifugal forces of the balance weights 15. To balance the centrifuge during the centrifugal separation, a dynamic balance must be maintained between the total centrifugal force vector of the buckets 31 which acts as an imbalancing factor due to the samples contained in the buckets 31, and the total centrifugal force vector of the balance weights 15 which compensates for or offsets the total centrifugal force vector of the buckets 31. A distance to move each balance weight 15 along each balance weight moving shaft 17 is obtained using a relational expression for the dynamic balance between the total centrifugal force of the buckets 31 and the total centrifugal force of the balance weights 15. The relational expression for the dynamic balance between the total centrifugal force of the buckets 31 and balance weights 15 is as follows.

$$\sum_{i=1}^{3} m_{b,i}\overline{r_{b,i}}\Omega^2 = -\sum_{i=1}^{3} m_{cw}\overline{r_{cw,i}}\Omega^2 \quad \text{[Equation 1]}$$

In the above equation 1, the factors $m_{b,i}$ and $m_{cw}$ denote the weight of each bucket 31 and the weight of each balance weight 15, respectively. The factors $\overline{r_{b,i}}$ and $\overline{r_{cw,i}}$ denote position vectors from the rotating shaft of the rotor toward centers of mass of the bucket 31 and the balance weight 15, respectively. The factor Ω denotes a rotating speed of the automatic balancing rotor. The equation 1 is for a three-arm rotor. The equation 1 shows that the left side, that is, the sum of centrifugal force vectors of three buckets 31 containing the samples, must be the same as that of the right side, that is, the sum of centrifugal force vectors of three balance weights 1, so that the total centrifugal force among them must theoretically become zero. From the equation 1, the distance $\overline{r_{cw,i}}$ that each balance weight 15 is moved can be obtained In the meantime, in the signal connection unit 140, the wiring layer (not shown), which is connected to an electrical circuit of both the balance weight moving motor 5 and the reference position sensors 13, is disposed around an output shaft of the rotor drive motor 180. Accordingly, in a state in which the output shaft of the rotor drive motor 180 is rotated at an appropriate angle, the wiring layer is removably connected to the wiring connection board (not shown) without the entanglement of electrical wires near the rotor arms 29.

In the balance weight moving unit 150, an output shaft of each balance weight moving motor 5 is axially coupled to each worm 7 to move the associated balance weight 15 along the associated balance weight moving shaft 17. In addition, the worm 7 engages with the associated worm gear 19 at an appropriate gear ratio. In such engagement of the worm 7 and worm gear 19, the worm gear 19 can be driven by the rotation of the worm 7, but the worm 7 cannot be reversely rotated by the rotation of the worm gear 19. Therefore, even when the rotor arms 29 rotate at high speed, the balance weights 15 are prevented from undesirably moving along the balance weight moving shafts 17 outwards due to the centrifugal force.

The automatic balancing rotor for centrifuges according to the present invention is not limited to the above-mentioned embodiment, and various modifications are possible, without departing from the scope and spirit of the invention.

For example, a two-arm swing rotor, a four-arm swing rotor or a swing rotor having five arms or more may be used in a centrifuge, in place of the three-arm swing rotor shown in the above-mentioned embodiment. In the case of the two-arm swing rotor, rotor arms are spaced out at 180° intervals. In the case of the four-arm swing rotor, rotor arms are spaced out at 90° intervals. In such a multi-arm swing rotor, balance weight moving units having the same structure must be provided in slots of rotor arms. Furthermore, an engagement of bevel gears or other gears may be used as a balance weight moving unit to control the movement of the balance weights 15 in place of the engagement of the worm 7 and the worm gear 19. Moreover, a multiple bearing may be used in the balance weight moving unit, in place of the thrust bearing 21 and the radial bearing 23 to support the balance weight moving shaft 17, to help smoothly rotate the balance weight moving shaft 17, and to sustain the centrifugal force of the balance weights. Alternatively, it may be embodied by combined application of the thrust bearing 21 and the radial bearing 23.

The invention claimed is:

1. An automatic balancing rotor for a centrifuge, comprising:

a plurality of rotating arms having the same radial length and being arranged around a centrifugal rotating shaft, and being spaced out at regular angular intervals, with a plurality of buckets containing samples therein supported by the rotating arms;

a balance weight provided in each of the rotating arms to be movable in a radial direction, thus compensating for imbalanced centrifugal force applied to the buckets during a centrifugal separation, the balance weight including an aperture through a center thereof; and a balance weight mover to horizontally move the balance weight in the radial direction of each of the rotating arms; the balance weight mover comprising:

a balance weight moving shaft radially provided in the rotating arm and having an outer surface thereof and extending through the aperture of the balance weight, the balance weight being mounted on and movable radia balance weight moving shaft.

2. The automatic balancing rotor for the centrifuge according to claim 1, wherein the buckets are supported in spaces defined between the rotating arms, respectively.

3. The automatic balancing rotor for the centrifuge according to claim 1, wherein:

each of the rotating arms comprises a slot formed through the rotating arm in the radial direction to receive therein the balance weight and guide the horizontal movement of the balance weight, the balance weight has an internal thread formed through the center of the balance weight, and the balance weight mover comprises:

a balance weight moving motor; a worm axially coupled to the balance weight moving motor; a worm gear engaging with the worm; the balance weight moving shaft being radially provided in the slot of the rotating arm and having an external thread on the outer surface thereof to engage with the internal thread of the balance weight, the balance weight moving shaft coaxially coupled at an end thereof to the worm gear.

4. The automatic balancing rotor for the centrifuge according to claim 1, further comprising:

a slot formed through each of the rotating arms in the radial direction to receive therein the balance weight and guide the horizontal movement of the balance weight; and a reference position sensor provided at a predetermined position in the slot of the rotating arm to sense the balance weight placed at a reference position.

5. An automatic balancing rotor for a centrifuge, comprising:

a plurality of rotating arms having the same radial length and being arranged around a centrifugal rotating shaft, and being spaced out at regular angular intervals, with a plurality of buckets containing samples therein supported by the rotating arms;

a balance weight provided in each of the rotating arms to be movable in a radial direction, thus compensating for imbalanced centrifugal force applied to the buckets during a centrifugal separation; and a balance weight mover to horizontally move the balance weight in the radial direction of each of the rotating arms; and wherein each of the rotating arms comprises a slot formed through the rotating arm in the radial direction to receive therein the balance weight and guide the horizontal movement of the balance weight, the balance weight has an internal thread formed through a center of the balance weight, and the balance weight mover comprises:

a balance weight moving motor; a worm axially coupled to the balance weight moving motor; a worm gear engaging with the worm; and a balance weight moving shaft radially provided in the slot of the rotating arm and having an external thread on an outer surface thereof to engage with the internal thread of the balance weight, the balance weight moving shaft coaxially coupled at an end thereof to the worm gear.

* * * * *